US009150384B2

(12) United States Patent
Coquerelle et al.

(10) Patent No.: US 9,150,384 B2
(45) Date of Patent: Oct. 6, 2015

(54) ELEVATOR INSTALLATION WITH REDUCED HOISTWAY DIMENSIONS

(75) Inventors: Thomas Coquerelle, Douai (FR); Frédéric Beauchaud, Coullons (FR); Pascal Rebillard, Gien Cedex (FR); Raphaël Picard, Gien Cedex (FR); Jean-Noël Cloux, Gien Cedex (FR); Fabrice Hamon, Gien Cedex (FR); Aurélien Tissier, Gien Cedex (FR); Franck Dominguez, Gien Cedex (FR); Stephane Gourjeande, Gien Cedex (FR); Michel Beeuwsaert, Gien Cedex (FR); Loï Duchamp, Gien Cedex (FR); Gérard Sirigu, Gien Cedex (FR); Hugues Fanielle, Gien Cedex (FR)

(73) Assignee: Otis Elevator Company, Farmington, CT (US)

( * ) Notice: Subject to any disclaimer, the term of this patent is extended or adjusted under 35 U.S.C. 154(b) by 1766 days.

(21) Appl. No.: 12/305,680

(22) PCT Filed: Jun. 26, 2006

(86) PCT No.: PCT/IB2006/001750

§ 371 (c)(1), (2), (4) Date: Dec. 19, 2008

(87) PCT Pub. No.: WO2008/001149

PCT Pub. Date: Jan. 3, 2008

(65) Prior Publication Data

US 2010/0155181 A1 Jun. 24, 2010

(51) Int. Cl.
*B66B 11/08* (2006.01)
*B66B 11/00* (2006.01)

(52) U.S. Cl.
CPC ..... *B66B 11/008* (2013.01); *B66B 11/0045* (2013.01)

(58) Field of Classification Search
CPC .. B66B 11/006; B66B 11/008; B66B 11/0045
USPC ..... 187/254, 266, 406, 251, 401
See application file for complete search history.

(56) References Cited

U.S. PATENT DOCUMENTS 6,095,288 A * 8/2000 Rivera et al. ..... 187/343
6,138,799 A * 10/2000 Schroder-Brumloop et al. ..... 187/252

(Continued)

FOREIGN PATENT DOCUMENTS

DE 20122517 U1 3/2006
EP 1437322 A1 7/2004

(Continued)

OTHER PUBLICATIONS

International Preliminary Report on Patentability for International application No. PCT/IB2006/001750 completed Jul. 10, 2008

(Continued)

*Primary Examiner* — Michael Mansen
*Assistant Examiner* — Michael Riegelman
(74) *Attorney, Agent, or Firm* — Carlson, Gaskey & Olds

(57) ABSTRACT

An elevator system comprises a hoistway (4), an elevator car (2) arranged to move vertically within the hoistway and a drive machine (10) arranged in the hoistway outside the travel path of the car (2) or vertical projection thereof. The car (2) is coupled to the machine (10) by a rope (18) which is guided by a pair of idler sheaves (26, 28) so as to pass under the car (2). The idler sheaves (26, 28) have a diameter of less than 120 mm. The disclosed arrangement allows both overhead space and pit depth to be minimised.

14 Claims, 3 Drawing Sheets

(56) References Cited

U.S. PATENT DOCUMENTS

| | | | | |
|---|---|---|---|---|
| 6,193,018 | B1 * | 2/2001 | Schroder-Brumloop et al. | 187/266 |
| 6,488,124 | B1 * | 12/2002 | Yasuda et al. | 187/254 |
| 6,598,707 | B2 * | 7/2003 | Nakagaki et al. | 187/256 |
| 6,619,433 | B1 * | 9/2003 | Robert et al. | 187/251 |
| 7,523,810 | B2 * | 4/2009 | Cloux et al. | 187/409 |
| 2002/0070080 | A1 * | 6/2002 | Nakagaki et al. | 187/266 |
| 2004/0206579 | A1 | 10/2004 | Baranda et al. | |
| 2005/0006180 | A1 | 1/2005 | Mustalahti et al. | |

FOREIGN PATENT DOCUMENTS

| | | | |
|---|---|---|---|
| EP | 1520831 | A1 | 4/2005 |
| EP | 1547960 | A2 | 6/2005 |
| JP | 2000318956 | A | 11/2000 |
| JP | 2002179356 | A | 6/2002 |
| JP | 2005255259 | A | 9/2005 |
| WO | 0208108 | A2 | 1/2002 |
| WO | WO 02/08108 | A * | 1/2002 |
| WO | 03043926 | A1 | 5/2003 |
| WO | 2005105644 | A1 | 11/2005 |
| WO | WO 2005/105644 | A * | 11/2005 |

OTHER PUBLICATIONS

International Search Report and Written Opinion of the International Searching Authority for International application No. PCT/IB2006/001750 mailed Mar. 20, 2007.

* cited by examiner

ELEVATOR INSTALLATION WITH REDUCED HOISTWAY DIMENSIONS

BACKGROUND

This invention relates to arrangements for reducing the necessary minimum dimensions required to install an elevator system, particularly by reducing the vertical space needed above the elevator car at the upper end of its travel and below the car at the lower end of its travel.

There is increasing demand for elevator installations to require as little vertical space as possible. In particular there is a desire in the art to provide installations which do away with the need for a machine room above the hoistway housing the machine and associated equipment for operating the elevator. There is also a desire to reduce the depth of the elevator pit.

WO 99/43589 discloses an arrangement in which the elevator machine is provided in the hoistway, between the guide rails to the side of the car, which removes the need to house the machine in a machine-room and thus goes some way to reducing the vertical dimensions of the hoistway.

SUMMARY

It is an object of the invention to provide an improvement or at least alternative to existing machine room-less elevator installations. When viewed from a first aspect the invention provides an elevator system comprising: a hoistway having a pit depth and an overhead height; an elevator car arranged to move vertically within the hoistway, the car having at least one idler sheave mounted thereon; a rope suspending the car via the idler sheave; and a drive machine arranged in the hoistway and engaging the rope to move the car, wherein said idler sheave is mounted at least partially within the vertical projection of the car and has a diameter of less than 120 mm and wherein the elevator system satisfies the condition that the sum of the pit depth and the overhead height is greater than the height of the car by no more than 1.4 meters.

Thus it will be seen by those skilled in the art that in accordance with the invention an elevator car arrangement is provided which, despite being under or over-slung, has a very low requirement for hoistway height in excess of the rise (this requirement being expressed by the amount by which the sum of the overhead height and pit depth exceed the car height). This is achieved by having a very small diameter for the idler sheave(s). This diameter is less than 120 mm and in fact in preferred embodiments it is 100 mm. By having the overhead height and pit depth to be as small as possible in aggregate, the cost of constructing or adapting a building to accommodate the elevator system is reduced; as is the constraint that the system places on the design of the building which is beneficial both for new buildings and for the range of existing buildings which can be converted. Of course in any given installation it may, within the constraints of a low overall hoistway height, be desirable to minimise in particular either the pit depth of the overhead height. To an extent one may be reduced at the expense of the other. For example opting for an underslung roping arrangement allows the overhead height to be minimised; whilst to minimise the pit depth would suggest the use of an overslung arrangement; recognising that in either case the actual choice may be dictated by other factors.

The meaning of the dimensions: pit depth; overhead height; and car height are well known in the art but for the avoidance of doubt they are defined as follows. The pit depth is the vertical distance between the floor of the lowermost landing and the bottom of the hoistway. This space typically accommodates the under-structure of the car, the buffers, the toe guard and an allowance for over-travel. The overhead height is the vertical distance between the floor of the uppermost landing and the top of the hoistway. This space must therefore accommodate at least the height of the car and the car roof structure. The car height is the distance between the internal floor of the car and the internal ceiling.

In accordance with conventional thinking if the skilled person were trying to minimise the height of the hoistway the car idler sheave(s) would either be omitted by employing a 1:1 roping arrangement (with the rope end coupled directly to the car) or would be provided outside the vertical projection of the car so as to be able at least partially to overlap the car in a vertical direction. However the applicant has realised that in fact vertical height can still be minimised while still realizing the benefits of 2:1 roping by locating the idler sheave(s) in the vertical projection of the car, thereby facilitating more balanced loading, as well as minimising the cross-sectional area required for the hoistway which also minimises building/conversion costs. In accordance with the invention the idler sheave(s) is/are provided at least partially and preferably fully within the vertical projection of the car.

Preferably the machine is provided between the wall of the hoistway and the elevator car. This further helps to assist minimising vertical hoistway dimensions.

A single idler sheave may be provided, e.g. at the centre of the top or bottom of the ca. Preferably a pair of idler sheaves is provided.

The elevator system is preferably of the traction drive type where the weight of the elevator car is balanced by a counterweight and the car is moved vertically by driving the rope with a traction sheave connected to the machine. Preferably the traction sheave is also less than 120 mm, preferably 100 mm or less in diameter. This helps to optimise the use of space in the hoistway by requiring less space to accommodate the traction sheave but also by minimising the torque requirements of the machine which in turn allows a smaller machine to be employed.

The rope must having a sufficiently small bending radius to pass around the small diameter sheaves employed in accordance with the invention. The rope could comprises small diameter cables, but preferably comprises at least one flat belt comprising a plurality of parallel, embedded cords.

In accordance with the invention the sum of the pit depth and the overhead height exceeds the car height by no more than 1.4 m, preferably no more than 1.2 m, more preferably no more than 1 meter, more preferably no more than 0.8 m and most preferably no more than 0.7 m.

Any suitable elevator machine may be used but preferably the machine is elongate i.e. longest in the direction of its axis of rotation. Most preferably the machine is gearless.

There are several possible roping configurations consistent with an under or over-slung arrangement in accordance with the invention. The ends of the rope are preferably secured at the upper end of the hoistway. They could be hitched to the wall or roof of the hoistway, or indeed any other suitable structure but preferably the ends of the rope are hitched, directly or indirectly, to guide rails provided for guiding the vertical movement of the car and/or the counter-weight. For instance at least one end of the rope could be hitched to a machine bedplate mounted to some of the guide rails. Such arrangements allow the guide rails to bear all of the forces of the elevator which also reduces the building cost since the walls and roof of the hoistway do not have to be specially reinforced.

The machine may be mounted in any conventional location in the hoistway outside the projection of the elevator car, but preferably it is mounted towards the upper end of the hoistway to minimize the amount of rope needed. The machine may be mounted to the wall or roof of the hoistway or any other suitable structure. Preferably it is mounted to one or more guide rails for guiding the car and/or counter-weight. As explained above this allows the guide rail(s) to bear all significant loads which relaxes the requirements on the surrounding building.

The Applicant has further appreciated that minimising the height of the counterweight can be of benefit in reducing the overall hoistway height. In other words the overall hoistway height cannot be reduced in some cases unless the counterweight is shorter. Of course all else being equal, a shorter counterweight will have less weight. This implies the use of a higher density material such as lead to ensure a proper balancing between the car and the counterweight. This is not desirable since it increases the cost and particularly in the case of lead would be counter to good environmental principles.

The Applicant has devised two measures to alleviate the aforementioned problem. The first is to employ a small diameter sheave, i.e. less than 120 mm, on the counterweight. Since the sheave contributes to the height of the counterweight, by reducing its diameter there is a correspondingly greater proportion of the height which can be used by weights.

Secondly the Applicant has recognised the benefit of maintaining the weight of the counterweight while its height is reduced by making it wider and accordingly by separating the guide rails between which it travels further than previously. In a typical elevator system with a car depth (front to back) of 1.4 m and a car width (side to side) of 1.1 m with the counterweight located at one of the two sides, the counterweight guide rails are separated by no more than 0.8 meters. This separation is limited by the elevator controller and drive being located at the same side as the counterweight in such a typical system.

In accordance with some preferred embodiments of the invention in which the car has a depth of between 1 meter and 1.6 meters, the elevator system comprises a pair of guide rails for the counterweight, said guide rails being separated by a distance of at least the depth of the car minus 0.2 meters.

This is novel and inventive in its own right and when viewed from a further aspect the invention provides an elevator system comprising an elevator car having a width between 1 meter and 1.6 meters and a counterweight suspended by a common rope wherein said counterweight is guided in its vertical movement by a pair of guide rails separated by a distance of at least the depth of the car minus 0.2 meters.

A preferred embodiment of the invention will now be described, by way of example only, with reference to the accompanying drawings in which:

DETAILED DESCRIPTION

Figure 1:
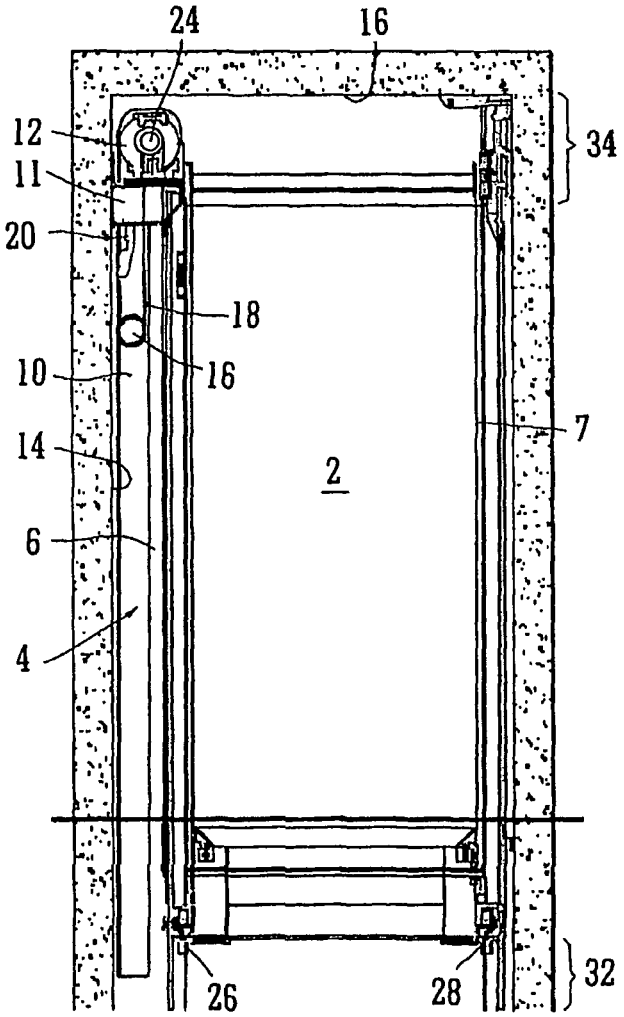
FIG. 1 is a front elevation of an elevator system in accordance with the invention.
Figure 2:
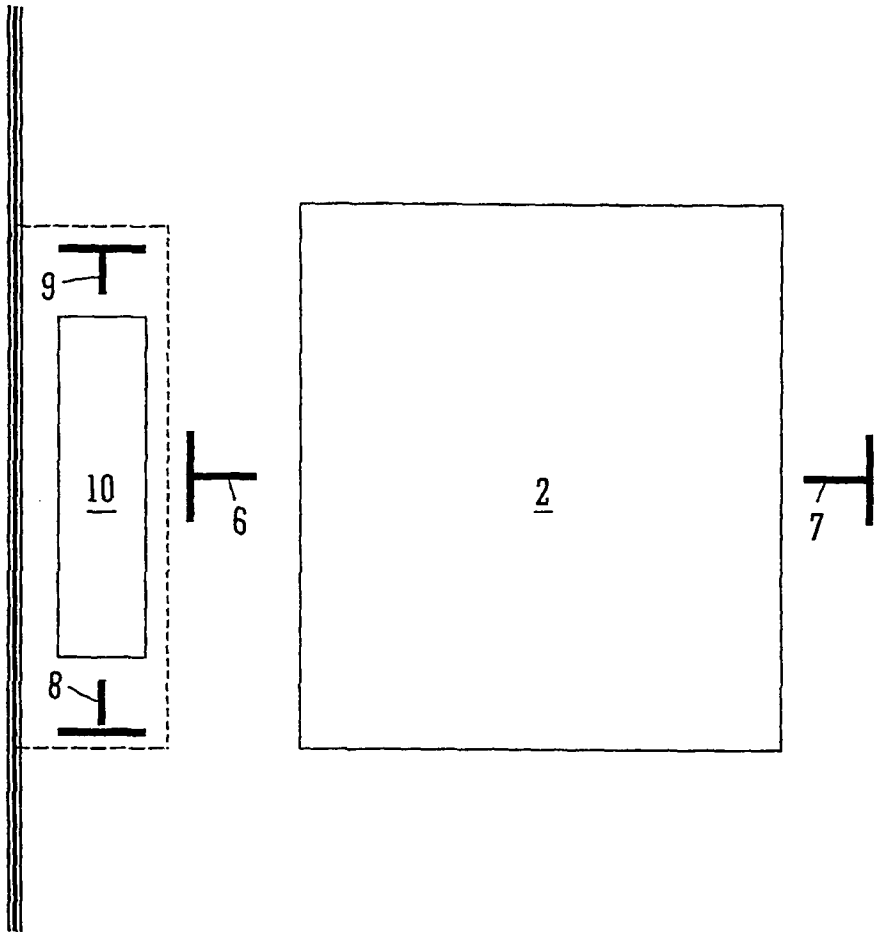
FIG. 2 is a schematic plan view of the hoistway showing the arrangement of guide rails.

Referring to FIGS. 1 and 2 there may be seen an elevator system comprising an elevator car 2 which is adapted to move vertically in a hoistway 4. Two vertical car guide rails 6,7 are provided in the hoistway 4 on either side of the elevator car 2. The guide rails 6,7 guide the vertical movement of the car 2. Also spaced across the left side of the hoistway (as viewed from FIGS. 1 and 2) is a pair of counterweight guide rails 8,9 which guide the vertical movement of a counterweight 10 extending between them. The counterweight 10 is shorter than conventional counterweights which allows its vertical travel to be accommodated within the reduced hoistway height of the embodiment described herein. It is provided with an idler sheave 16 at the top thereof which has a diameter which is only of the order of 100 mm. The horizontal spacing of the counterweight guide rails is greater than in prior art systems which in turn allows the counterweight 10 to be wider, mitigating the reduction in its height. To give an example the counterweight guide rails are spaced apart by a distance which is 0.2 meters less than the depth of the car.

Attached to the top of the left car guide rail 6 and the two counterweight guide rails 8, 9 is a machine bedplate 11 which serves to mount the elevator machine 12. The machine 12 is of the elongate gearless type, known per se in the art. The axis of the machine 12 is preferably parallel to the line joining the two counterweight guide rails. By being mounted to the three guide rails 6,8,9 via the bedplate 11, the weight of the machine 12 and its load is transmitted downwardly by the guide rails to the floor of the hoistway and does not need to be borne by the walls 14 or ceiling 16 of the hoistway. This arrangement also means that the machine 12 is alongside the car 2 in the hoistway between the car and the wall 14. Since it is outside the vertical projection of the car 2, the machine does not add to the overall height of the hoistway 4.

Figure 3:
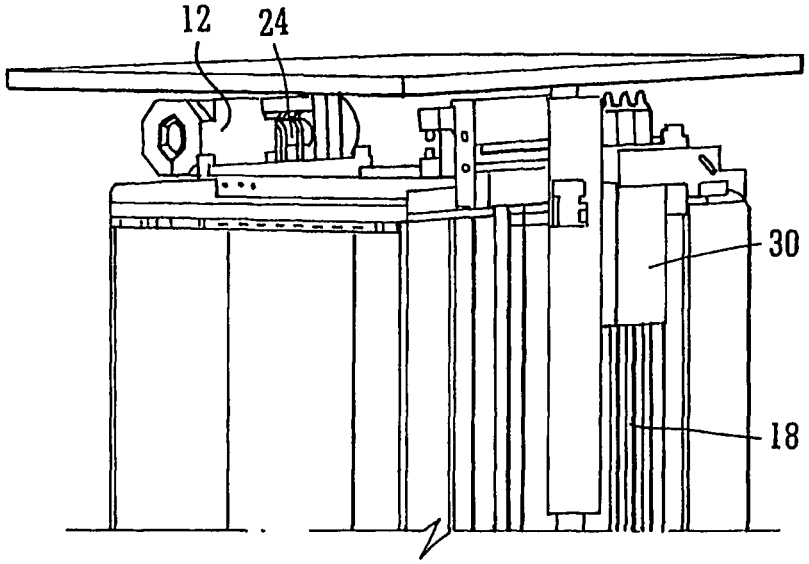
FIG. 3 is a perspective view showing the top and bottom of the elevator car.
Figure 3:
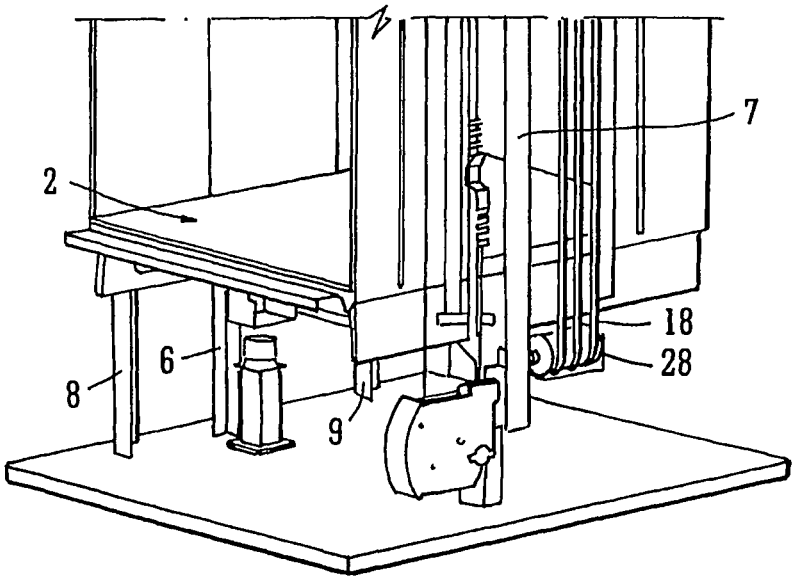

The elevator rope 18 is shown as three separate belts but could in fact comprise small diameter cables, conventional cables or combinations thereof. Plural small diameter cables or a flat belt (comprising, in effect, very small diameter cables embedded in a jacket) are preferred as they offer the most advantageous ratio of bending radius to load strength. The rope 18 is hitched at one end to the bedplate 11 with a so-called dead-end hitch 20, well known per se in the art. The rope 18 passes downwardly from the dead-end hitch 20 around the sheave 16 provided on the top of the counterweight 16. It then passes up and over a traction sheave 24 (see FIG. 3) which is fixed to or integral with the spindle of the machine 12 so as to be driven by it. As may be appreciated from FIG. 3, the diameter of the traction sheave 24 in this embodiment is very small, e.g. 100 mm or less.

From the traction sheave 24 the rope 18 passes downwardly and around an idler sheave 26 mounted to the bottom of the elevator car 2, within the vertical projection of the car. The idler sheave 26 is also of a very small diameter, again approximately 100 mm. The rope 18 passes underneath the car 2 and around a second, identical idler sheave 28 also within the vertical projection of the car, from where it passes upwardly to another dead-end hitch 30 mounted to the opposite guide rail 7.

The roping configuration set out above is a 2:1 configuration. However, as will be appreciated from the Figures, by employing very small diameter idler sheaves 26,28 the amount of vertical space required beneath the car 2 when at its lowest landing, in other words the minimum depth needed for the hoistway pit 32, is reduced. Similarly by using an underslung suspension arrangement and locating the machine 12 out of the vertical projection of the car 2, a very small overhead space 34 can be used.

To give some numerical examples, a typical height for the car would be 2100 millimeters. In accordance with the invention the pit may be as shallow as 300 mm and the overhead height 2500 millimeters giving an aggregate of 2800 mm which is in excess of the car height by just 700 mm or 33% of the car height.

It will further be appreciated that by mounting the two dead-end hitches 20,30 and also the machine 12 directly, or indirectly via the bedplate, to the guide rails 6,7,8,9, the bulk of the weight of the elevator system and its operating forces are transmitted by the guide rails down through the pit 32 and then e.g. into the foundations of the building without these having to be borne by the walls or ceiling 14, 16 of the hoist-way which therefore do not require special reinforcement.

The preceding description is exemplary rather than limiting in nature. Variations and modifications to the disclosed embodiments will be apparent to those skilled in the art without departing from the scope of this invention, which is defined in the following claims.

The invention claimed is:

1. An elevator system, comprising:

a hoistway having a pit depth and an overhead height;

an elevator car arranged to move vertically within the hoistway, the elevator car having at least one idler sheave mounted thereon, the elevator car having a front-to-back depth between 1 and 1.6 meters and sides that have a horizontal length corresponding to the depth;

a rope suspending the car via the idler sheave;

a counterweight suspended by the rope and positioned on one of the sides of the elevator car;

first and second counterweight rails that guide movement of the counterweight, the counterweight rails being separated by a distance of at least the front-to-back depth minus 0.2 meters; and a drive machine arranged in the hoistway and engaging the rope to move the car, wherein said idler sheave is mounted at least partially within the vertical projection of the car and has a diameter of less than 120 mm and wherein the elevator system satisfies the condition that the sum of the pit depth and the overhead height is greater than the height of the car by no more than 1.4 meters.

2. An elevator system as claimed in claim 1, wherein said machine is located outside the travel path of the car or vertical projection thereof.

3. An elevator system as claimed in claim 1, comprising a pair of idler sheaves guiding the rope so as to pass under or over the car.

4. An elevator system as claimed in claim 1, wherein said rope is driven by a traction sheave less than 120 mm in diameter connected to the drive machine.

5. An elevator system as claimed in claim 1, wherein the machine is elongate.

6. An elevator system as claimed in claim 1, wherein the machine is gearless.

7. An elevator system as claimed in claim 1, wherein the ends of the rope are secured at the upper end of the hoistway.

8. An elevator system as claimed in claim 1, wherein at least one of the ends of the rope is hitched, directly or indirectly to one or more guide rails for guiding the vertical movement of the car or a counterweight.

9. An elevator system as claimed in claim 1, wherein the machine is mounted towards the upper end of the hoistway.

10. An elevator system as claimed in claim 1, wherein the machine is mounted to one or more guide rails for guiding the car or counterweight.

11. An elevator system as claimed in claim 1, wherein the sum of the pit depth and the overhead height is greater than the height of the car by no more than 1 meter.

12. An elevator system as claimed in claim 1, wherein the sum of the pit depth and the overhead height is greater than the height of the car by no more than 0.7 meters.

13. An elevator system as claimed in claim 1, wherein said rope comprises at least one flat belt.

14. An elevator system as claimed in claim 1, comprising a counterweight idler sheave having a diameter less than 120 mm.

* * * * *